US010602865B2

(12) United States Patent
Steele

(10) Patent No.: US 10,602,865 B2
(45) Date of Patent: Mar. 31, 2020

(54) MEAL TIER SYSTEM

(71) Applicant: Ann Steele, Little Elm, TX (US)

(72) Inventor: Ann Steele, Little Elm, TX (US)

( * ) Notice: Subject to any disclaimer, the term of this patent is extended or adjusted under 35 U.S.C. 154(b) by 0 days.

(21) Appl. No.: 15/984,342

(22) Filed: May 19, 2018

(65) Prior Publication Data

US 2019/0350396 A1 Nov. 21, 2019

(51) Int. Cl.

| | |
|---|---|
| ***A47G 23/08*** | (2006.01) |
| ***B65D 21/02*** | (2006.01) |
| ***B65D 77/04*** | (2006.01) |
| ***B65D 25/28*** | (2006.01) |
| ***B65D 25/08*** | (2006.01) |

(52) U.S. Cl.
CPC ..... *A47G 23/08* (2013.01); *B65D 21/0217* (2013.01); *B65D 25/08* (2013.01); *B65D 25/2826* (2013.01); *B65D 77/0406* (2013.01)

(58) Field of Classification Search
CPC .... A47G 23/08; A47G 23/06; A47G 23/0616; A47G 23/0683; A47G 23/0691; B65D 25/04; B65D 25/2826; B65D 21/0209; B65D 21/0223
USPC ..... 220/4.27, 4.26
See application file for complete search history.

(56) References Cited

U.S. PATENT DOCUMENTS

| | | | | |
|---|---|---|---|---|
| 4,208,826 | A * | 6/1980 | Lindaman | A01K 97/06 206/811 |
| 5,415,309 | A | 5/1995 | Wang | |
| 6,041,935 | A * | 3/2000 | Yang | A45C 11/00 206/509 |
| 6,257,401 | B1 | 7/2001 | Mangla | |
| 6,648,390 | B1 * | 11/2003 | Yang | A47B 49/00 206/821 |
| 2007/0196541 | A1 | 8/2007 | Vovan | |
| 2010/0307116 | A1 | 12/2010 | Fisher | |
| 2011/0031153 | A1 | 2/2011 | Vovan | |

* cited by examiner

*Primary Examiner* — Stephen J Castellano

(57) ABSTRACT

The invention is directed to a meal tier system. The system provides a plurality of cylindrical meal containers which stack neatly in tiers, and are removably affixed to a side-mounted spindle. Each container provides a watertight lid and may be individually swiveled around the axis of the spindle. The containers are dishwasher safe and may be insulated. Optionally, a large, sturdy bag with a carrying handle may be provided, such that the entire system, with all containers filled with food, may be fully assembled and securely carried in the bag with one hand.

7 Claims, 1 Drawing Sheet

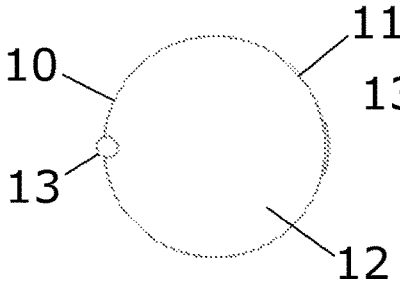
FIG.1
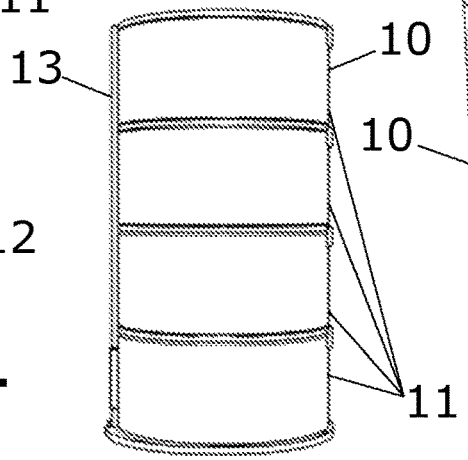
FIG.2
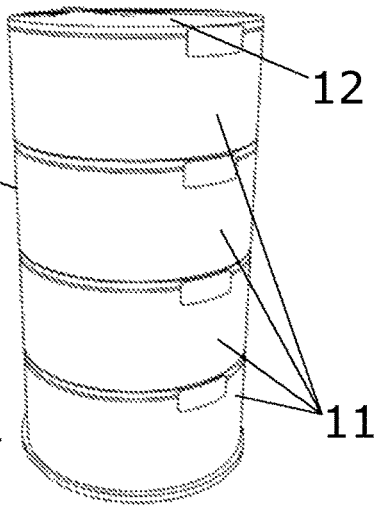
FIG.3
FIG.4
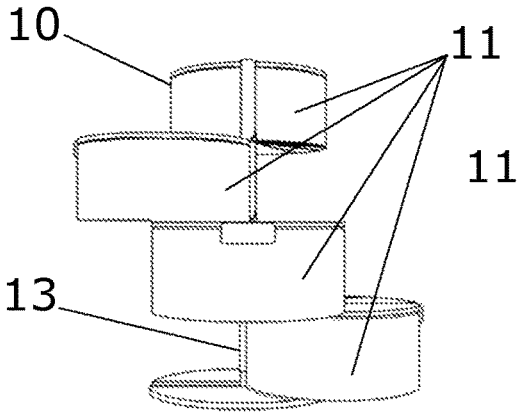
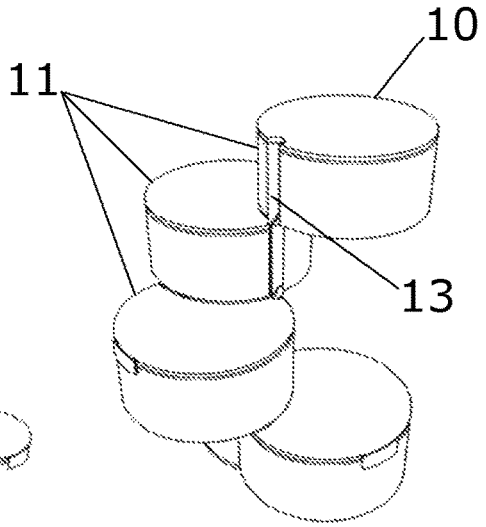
FIG.5
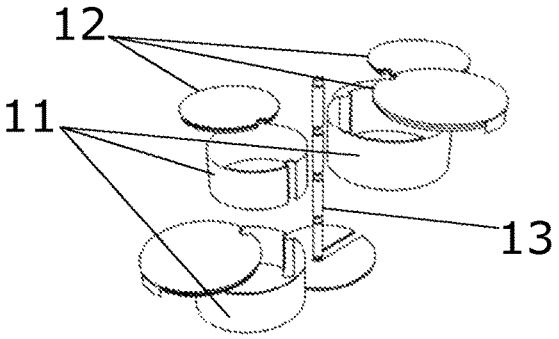
FIG.6

MEAL TIER SYSTEM

CROSS-REFERENCE TO RELATED APPLICATIONS

This application relates back to, and claims the priority of Provisional Patent Application No. 6254442 filed on Jun. 23, 2017.

STATEMENT REGARDING FEDERALLY SPONSORED RESEARCH OR DEVELOPMENT

Not Applicable

PARTIES TO A JOINT RESEARCH AGREEMENT

Not Applicable

REFERENCE TO SEQUENCE LISTING, A TABLE, OR A COMPUTER PROGRAM LISTING COMPACT DISK APPENDIX

Not Applicable

BACKGROUND OF THE INVENTION

The invention relates generally to storage containers, and in particular to a meal tier system. Preparing and storing meal servings for a family or other small group, or a series of meals for an individual, may prove to be difficult since so many containers must be filled, carried, and stored. The frustrations of dealing with multiple food containers have limited their usefulness. In particular, carrying a number of filled containers can be difficult.

A search of the prior art reveals various devices which have been developed to provide the features of water skis, which are propelled by the muscle action of the user, or otherwise propelled without being towed by a boat. None are closely related to the present invention, but several include features which resemble those of the present invention. Each has proven to be less than satisfactory for the present purpose in its own way.

Airtight multiple food containers, U.S. Pat. No. 5,415,309 (priority Aug. 9, 1994), provides multiple containers for carrying the same or different types of food independently of one another, and which may be securely locked to one another in a compact stack for ease of carrying. The upper container is provided with a channel for receiving a utensil receptacle in a snap-fit relationship, and a utensil in the form, for example, of a plastic spoon-shaped fork is pivotally mounted to the receptacle to be turned to extend along the underside of the receptacle when the receptacle is mounted in place on the cover of the upper container, and which may be turned to extend out of the end of the receptacle when the utensil is to be used.

Multiple-atmosphere, nested food container, U.S. Patent Appl. No. 2010/0307116A1 (priority Jun. 4, 2009), provides a multi-atmosphere, nested food container having an opaque, thermoformed top tray with a modified atmosphere other than air for storing unpackaged, perishable food items therein nested within a transparent, thermoformed bottom tray having a non-modified atmosphere for prepackaged food items. The top tray is sealed with a transparent common air impermeable flexible film to allow for viewing of the food items therethrough. The top tray nests inside of the bottom tray such that a bottom surface of the top tray is placed inside of an opening at the top surface of the bottom tray. This orientation allows for the top tray to remain in a relatively upright position such that the top surface of the top tray remains visible to consumers.

Multi-compartment container system, U.S. Patent Appl. No. 2011/0031153A1 (priority Dec. 19, 2005), provides a food container system that comprises a tray member that is the primary storage container, a first lid member that is molded to comprise a plurality of recesses of either similar or varying sizes to house various foodstuffs, and optionally a third lid member. When assembled, the foodstuff in the first lid member may be retained by a foil that adheres to the mouths of the recesses or the optional third lid member which may be formed to snugly fit over the recesses of the first lid member. The foodstuffs may be mixed in any combination desired. Embodiments of the invention will include for the tray member that may be releaseably attached to either the first or second lid member via a snap-fit grip mechanism; additionally, the first and second lid members may be releaseably attached to each other in a similar manner. The utility of the container system is magnified through the multi-compartmentalized lid member.

Domed food container system, U.S. Patent Appl. No. 2007/0196541A1 (priority Feb. 21, 2006), provides a rigid polymer domed food container system suitable for heated food products. Recessed vents in the lid of the food container systems permit stacking of multiple container systems while allowing heated gases to escape without restriction. Other features of this container system include the retention of food product within the central region of the tray, rigidized handholds to allow the consumer to lift the heated container, and a releaseably lockable snap-fit grip mechanism that facilitates opening of the container system among other things.

Vented container with handles and embossment, U.S. Pat. No. 6,257,401 (priority May 14, 1999), provides a thermoplastic container for food or other articles. The container includes a base having a bottom, a pair of opposing side walls and a pair of opposing end walls extending upwardly from the bottom. A pair of integral handle segments are formed with the outer rim of the base and rotatably attached to anchoring portions at integral hinges. The handle segments can be releasably engaged with each other and include a pair of hinged portions. Each hinged portion has at least one upwardly extending rib segment and at least one downwardly extending rib segment interconnected by integral hinges that form definite bending points for the hinged portions of the handle segments so that when the handle segments are upturned, the hinged portion assists in distributing stress and obtaining a proper balance of the container. A plurality of wells designed to retain fluid therein via capillary action or surface tension forces are formed in the bottom such that fluid does not flow out of the wells when the base is tilted or turned upside-down. A cover may be removably attached to the base to define a food storage chamber. A downwardly extending rib formed in the cover rim is intermittently provided with a plurality of cover venting notches which are aligned with respective base venting notches formed in an upwardly extending elongated rib of the base. With the cover in place atop the base, the conjunction of the base venting notches and the cover venting notches define vent openings. Another set of apertures for additional ventilation are provided in the side walls of the cover. Also, multiple containers can be stacked atop each other and the bottom includes at least one elongated recess for substantially receiving a portion of the handle segments to facilitate stacking.

The purpose of the present invention is to correct the deficiencies in the existing inventions cited herein, and thereby provide a substantial improvement over all the prior art. If meal containers could be developed which enable the user to effortlessly fill and carry several containers, and can be stored compactly, they would be well received. A meal tier system, which provides a plurality of cylindrical meal containers removably affixed to a side-mounted spindle, would resolve these problems.

SUMMARY OF THE INVENTION

Accordingly, the invention is directed to a meal tier system. The system provides a plurality of cylindrical meal containers which stack neatly in tiers, and are removably affixed to a side-mounted spindle. Each container provides a watertight lid and may be individually swiveled around the axis of the spindle. The containers are dishwasher safe and may be insulated. Optionally, a large, sturdy bag with a carrying handle may be provided, such that the entire system, with all containers filled with food, may be fully assembled and securely carried in the bag with one hand.

Additional features and advantages of the invention will be set forth in the description which follows, and will be apparent from the description, or may be learned by practice of the invention. The foregoing general description and the following detailed description are exemplary and explanatory and are intended to provide further explanation of the invention.

BRIEF DESCRIPTION OF THE DRAWINGS

The accompanying drawings are included to provide a further understanding of the invention and are incorporated into and constitute a part of the specification. They illustrate one embodiment of the invention and, together with the description, serve to explain the principles of the invention.

FIG. 1 is a top view of the first exemplary embodiment, displaying the system 10, the container 11, the lid 12, and the spindle 13.

FIG. 2 is a side view of the first exemplary embodiment, displaying the system 10, the containers 11, and the spindle 13.

FIG. 3 is a side perspective view of the first exemplary embodiment, displaying the system 10, the containers 11, and the lid 12.

FIG. 4 is a side view of the first exemplary embodiment with the containers in offset positions, displaying the system 10, the containers 11, and the spindle 13.

FIG. 5 is a side perspective view of the first exemplary embodiment with the containers in offset positions, displaying the system 10, the containers 11, and the spindle 13.

FIG. 6 is a side perspective exploded view of the first exemplary embodiment with the containers in offset positions, displaying the containers 11, the lids 12, and the spindle 13.

DETAILED DESCRIPTION OF THE INVENTION

Referring now to the invention in more detail, the invention is directed to a meal tier system 10.

The first exemplary embodiment is comprised of a plurality of cylindrical meal containers 11 which stack neatly in tiers, and are removably affixed to a side-mounted spindle 13. Each container 11 provides a watertight lid 12 and may be individually swiveled around the axis of the spindle 13. For secure carrying, the containers 11 may be temporarily locked into a vertical stack. The containers 11 may provide removable, compartmented inserts such that separate dishes of the same meal may be stored and carried separately, such as roast beef, mashed potatoes, and green beans.

The containers 11 are dishwasher safe and may be insulated. Optionally, a large, sturdy bag with a carrying handle may be provided, such that the entire system 10, with all containers 11 filled with food, may be fully assembled and securely carried in the bag with one hand. Alternately, a carrying handle may be provided at the upper end of the spindle 13.

To use the first exemplary embodiment, the user may fill the containers 11 with food, affix the lids 12 to the containers 11, and then affix the containers 11 to the spindle 13. The system 10 may then be easily carried and stored.

The containers 11, the lids 12, and the spindle 13 are preferably manufactured from rigid, durable materials which are dishwasher safe, such as plastic and ceramics. Components, component sizes, and materials listed above are preferable, but artisans will recognize that alternate components and materials could be selected without altering the scope of the invention.

While the foregoing written description of the invention enables one of ordinary skill to make and use what is presently considered to be the best mode thereof, those of ordinary skill in the art will understand and appreciate the existence of variations, combinations, and equivalents of the specific embodiment, method, and examples herein. The invention should, therefore, not be limited by the above described embodiment, method, and examples, but by all embodiments and methods within the scope and spirit of the invention.

I claim:

1. A meal tier system comprised of:

a plurality of cylindrical meal containers which stack neatly in tiers, a support having a stable base and an upright spindle extending upwardly from the base, said meal containers are stackable upon the stable base, each meal container having a watertight lid covering a top opening of said meal container in a removable manner, each meal container is removably affixed to said upright spindle in a side-mounted manner such that each meal container swivels around the axis of the upright spindle independently of the other meal containers, each watertight lid having a peripheral edge with a notch shaped to the outer contour of the upright spindle such that each watertight lid properly fits the top opening of its respective meal container.

2. The meal tier system of claim 1, wherein for secure carrying purposes, the meal containers are capable of being temporarily locked into a vertical stack.

3. The meal tier system of claim 1, wherein the meal containers are dishwasher safe and are insulated.

4. The meal tier system of claim 1, wherein food is received into the meal containers, the watertight lids are affixed to the meal containers, and then the meal containers are affixed to the upright spindle, such that the system is easily carried and stored.

5. The meal tier system of claim 1, wherein the meal containers, the watertight lids, and the upright spindle are manufactured from rigid, durable materials which are dishwasher safe.

6. The meal tier system of claim 1, wherein each meal container has a bottom wall and a circumferential sidewall, a vertically extending groove is provided in the outer surface of the sidewall, the vertically extending groove receives a portion of the upright spindle when affixed thereto.

7. The meal tier system of claim 6, wherein the vertically extending groove on the meal container's sidewall and the notch on the lid's peripheral edge align when the lid fits the top opening of the meal container.

* * * * *